US007468643B2

(12) United States Patent
Ninomiya et al.

(10) Patent No.: US 7,468,643 B2
(45) Date of Patent: Dec. 23, 2008

(54) BANDPASS FILTER AND WIRELESS COMMUNICATIONS EQUIPMENT USING SAME

(75) Inventors: Hiroshi Ninomiya, Kirishima (JP); Katsurou Nakamata, Kirishima (JP)

(73) Assignee: Kyocera Corporation, Kyoto (JP)

( * ) Notice: Subject to any disclaimer, the term of this patent is extended or adjusted under 35 U.S.C. 154(b) by 307 days.

(21) Appl. No.: 11/413,952

(22) Filed: Apr. 28, 2006

(65) Prior Publication Data

US 2006/0255886 A1 Nov. 16, 2006

(30) Foreign Application Priority Data

Apr. 28, 2005 (JP) ..... 2005-132568
Dec. 22, 2005 (JP) ..... 2005-370939

(51) Int. Cl.
*H01P 1/203* (2006.01)
*H01P 1/213* (2006.01)

(52) U.S. Cl. ..... 333/204; 333/134

(58) Field of Classification Search ..... 333/134, 333/203–205

See application file for complete search history.

(56) References Cited

U.S. PATENT DOCUMENTS 5,373,271 A * 12/1994 Hirai et al. ..... 333/205
6,326,866 B1 * 12/2001 Sasaki et al. ..... 333/203
6,696,903 B1 * 2/2004 Kawahara et al. ..... 333/134
2003/0085780 A1 * 5/2003 Wang ..... 333/204

FOREIGN PATENT DOCUMENTS

JP 2002374102 A * 12/2002

* cited by examiner

*Primary Examiner*—Seungsook Ham
(74) *Attorney, Agent, or Firm*—Hogan & Hartson LLP

(57) ABSTRACT

Disclosed is a bandpass filter comprising a first resonator 1 to a sixth resonator 6 having lengths of basically ¼ wavelength, an input section IN connected to an ungrounded end of the first resonator, and an output section OUT connected to an ungrounded end of the sixth resonator, wherein the second to fifth resonators 2-5 are electromagnetically coupled with each other, the second and the third resonators are respectively coupled to the first resonator via the first and the second capacitances C1,C2, the third and the fourth resonators are respectively coupled to the sixth resonator via the third and the fourth capacitances C3,C4, and the input section IN and output section OUT are coupled to the first resonator and sixth resonator through an input and output capacitances C5, C6, respectively. This bandpass filter can be a small size, low loss filter suitable for UWB (Ultra Wide Band).

13 Claims, 12 Drawing Sheets

SURFACE LAYER

2nd LAYER

3rd LAYER

4th LAYER

5th LAYER

6th LAYER

7th LAYER

8th LAYER

9th LAYER

10th LAYER

11th LAYER

12th LAYER

BACKSIDE SURFACE LAYER

9th LAYER

10th LAYER

11th LAYER

12th LAYER

BACKSIDE SURFACE LAYER

BANDPASS FILTER AND WIRELESS COMMUNICATIONS EQUIPMENT USING SAME

BACKGROUND OF THE INVENTION

1. Field of the Invention

The present invention relates to a bandpass filter with wide bandpass characteristics and steep attenuation characteristics which is used suitably for UWB (Ultra Wide Band) in the wireless communications field, and communications equipment using the bandpass filter. UWB is expected to be utilized as a data transmitting medium for PC peripheral equipment such as external storage devices, printers and scanners, or as a data communications medium for digital TVs, projectors, digital steel cameras, digital video cameras, etc.

2. Description of the Related Art

In recent years, attention is being given to UWB as a means of communications. This UWB is different from wireless local area network (herein after referred to as "W-LAN") in communication length and data transmission rate.

According to IEEE802.11.b, one of the standards for W-LAN, the communication length is 30-100 m, transmission power is 500 mW and transmission rate is about 11 Mbps. On the other hand, in UWB, while communication length is as short as 10 m for a passband of 3.1-4.9 GHz, the transmission power is as low as 100 mW and the transmission rate is 100 Mbps for a communication length of around 10 m, and 480 Mbps for a communication length of less than 2 m, and therefore, data transmission at higher rate is possible as compared with W-LAN.

As discussed above, one of the features of UWB is achieving a high transmission rate by use of a wide frequency band. Its fractional bandwidth (bandwidth/center frequency) is greater than 40%, or 110% or more depending on the case.

Another feature of UWB is that its average transmission power density is defined to be as low as −41.25 dBm/MHz or less. The value of −41.25 dBm/MHz corresponds to a radiant power generating an electric field strength of 54 dBμV=500 μV/m at a distance of 3m from the wave source.

To take an example of a spectral mask under an outdoor circumstance, with the range of 3.16 GHz to 4.75 GHz being set as the base(0 dB) for bandwidth of wireless equipment, it is defined so that it is less than −20 dB at 3.1 GHz and less than −30 dB at 1.61 GHz. Meanwhile, since it is necessary to prevent interference with W-LAN (IEEE802.11.a/b/g) in substantial conditions of use, there are respective attenuation characteristics required for 2.48 GHz and 5.15 GHz.

As described above, a bandpass filter inserted in transmission and receiving signal flow paths in wireless communications equipment for UWB is required to have a wide frequency band (fractional bandwidth of 40% or more) and low loss and high attenuation.

SAW filters and BAW filters using crystalline quartz or piezoelectric ceramics that have high Q factor as the base material have been conventionally used as bandpass filters with low loss and high attenuation in narrow frequency bands. The fractional bandwidths of these are 3-4% or less at a center frequency of 2 GHz, and passbands thereof are 0.06-0.08 GHz, which are two orders of magnitude narrower than those of UWB. Since bandwidths in these materials are determined depending on the electromechanical coupling coefficients of crystalline quartz and piezoelectric substrates, extending the bandwidths to be used as bandpass filters for wider frequency bands has been difficult when the material is taken into consideration.

For this reason, using a dielectric filter including a plurality of dielectric resonators with high Q combined together has been known as one approach for obtaining a bandpass filter with steep attenuation characteristics in a frequency band of 2-5 GHz. However, in order to produce a dielectric filter so that it has a center frequency of 3.98 GHz, a bandwidth of 1.6 GHz, and attenuation of less than −30 dB at 2.48 GHz and 5.15 GHz where W-LAN operates, the size thereof is bound to be as large as about 10×3×1.5 mm, which is disadvantageous. Dielectric filters thus fail to have a wide passband and small size at the same time.

A primary object of the present invention is to provide a small size bandpass filter with a wide passband in UWB and steep attenuation characteristics in a narrow frequency band, and wireless communications equipment using the same.

SUMMARY OF THE INVENTION

A bandpass filter according to the present invention comprises a plurality of resonators formed on a dielectric layer, wherein the plurality of resonators each comprise a conductor pattern whose length in a signal propagation direction is basically λ/4 when the propagation wavelength at a generally center frequency of a passband is represented by λ, and one ends of the plurality of resonators are each grounded as grounded ends, the grounded ends being arranged on the same side and juxtaposed in sequence on the dielectric layer, the resonators being arranged such that an ungrounded end of a resonator located at a first location is connected to an input terminal electrode, an ungrounded end of another resonator located at a last location is connected to an output terminal electrode, resonators adjacent to each other located at an intermediate location are electromagnetically coupled with each other, and the ungrounded end of the resonator located at the first location is connected to ungrounded ends of the resonators located at the intermediate location through capacitances, and the ungrounded end of the resonator located at the last location is connected to the ungrounded ends of the resonators located at the intermediate location through capacitances.

The bandpass filter with this structure allows the resonators located at the intermediate location to be electromagnetically coupled with each other. Because of this coupling, selecting an appropriate amount of capacitance for each resonator allows a bandpass filter to have a wide passband. In addition, providing a plurality of resonators enables the filter to have steep attenuation characteristics.

In addition, for the coupling between the ungrounded end of the resonator located at the first location and the input terminal electrode, and the coupling between the ungrounded end of the resonator located at the last location and the output terminal electrode, capacitance or inductance maybe used. In this case, since strong coupling can be effected upon input and output of signals at the input section and output section by setting the constant of the each element at a predetermined value, transmission loss of the bandpass filter can be reduced.

The shape of the conductor plate constituting each of the resonators is basically rectangular.

The resonators may comprise, for example, strip lines, microstrip lines, or coplanar lines.

Any or all of the ungrounded ends of the resonators located at an intermediate location are preferably grounded through capacitances (namely, C7-C10 shown in FIG. 2).

This allows the lengths of the resonators to be less than ¼ wavelength, which makes it possible to reduce the size in the longitudinal direction of the bandpass filter, and as a result, the bandpass filter can be packaged with high density.

Generally, energy distribution of a resonator with one end grounded is such that, with respect to the longitudinal direction, the electric field energy is highest at the ungrounded end, and the electric field energy weakens with proximity to the other end that is grounded. On the other hand, the magnetic field energy is highest at the grounded end, and the magnetic field weakens with proximity to the ungrounded end. Electric field-energy is defined as $CV^2/2$ (C: capacitance, V: voltage), and magnetic field is defined as $LI^2/2$ (L: inductance, I: current). In order to reduce the length of a resonator, a way to obtain the same energy from a factor other than resonator maybe devised. Accordingly, increasing the capacitance at the ungrounded end or increasing the inductance at the grounded end may be chosen. The length of a resonator can be reduced by providing the ungrounded end of the resonator with a capacitance also in the bandpass filter according to the present invention. Thus, miniaturization of bandpass filter can be realized.

Moreover, when a bandpass filter according to the present invention is formed in a multilayer dielectric substrate comprising a plurality of dielectric layers stacked one upon another, by using a dielectric with a high dielectric coefficient, a miniaturized, low-profile bandpass filter can be realized.

When the resonators are arranged so that they are vertically sandwiched by upper and lower grounded electrodes formed on dielectric layers, establishing a ground path from the grounded electrodes to the grounded ends of the plurality of resonators can be easily accomplished. In addition, electromagnetic shielding effect can also be obtained from the vertically sandwiching grounded electrodes.

The distance between the foregoing upper and lower grounded electrodes is preferably less than 1.0 mm. This allows reduction of the thickness of the multilayer dielectric substrate.

The number of the plurality of resonators may be six, for example.

Since generally, loss is generated in resonators, increasing the number of the resonators leads to an increase in loss within a passband. To take a bandpass filter using the Chebyshev function with a passband of 3.16 GHz-4.75 GHz as an example, when the ripple was 0.2 dB and Q of resonator was 180, while the loss was about −1.0 dB, the attenuation was as inadequate as about −18 dB in the case of resonators with a five-stage structure.

In the case of resonators with a seven-stage structure, while the attenuation was about −32 dB, the loss was as great as −1.9 dB. It has been theoretically verified that in the case of resonators with a six-stage structure, sufficient results were obtained for both, which were a loss of −1.6 dB and an attenuation of −25 dB.

Therefore, when six-stage resonators are employed, a steep attenuation pole can be formed on the lower frequency side of the passband due to a parallel resonance phenomenon caused by strong electric coupling and weak magnetic coupling between the first resonator and second resonator, and a parallel resonance phenomenon caused by strong electric coupling and weak magnetic coupling between the sixth resonator and the fifth resonator.

A steep attenuation pole can be realized on the higher frequency side of the passband due to a capacitance (the first capacitance) provided between the first resonator and second resonator, the second resonator, and magnetic coupling between the second resonator and the third resonator, and another steep attenuation pole can be realized on the higher frequency side of the passband due to a capacitance (the second capacitance) provided between the first resonator and third resonator, the third resonator, and magnetic coupling between the third resonator and the fourth resonator.

Meanwhile, since the structure of the bandpass filter using six-stage resonators according to the present invention can be symmetrical with respect to the third and fourth resonators, it has a merit in that the circuits can be patterned more easily than bandpass filters using five or seven resonators.

Furthermore, it is preferable that the distances between the ungrounded ends of all of the first to sixth resonators and the capacitances connected to the ungrounded ends are generally equal when viewed in the stacking direction.

In this structure, the lengths of a total of six resonators including the first to sixth resonators including the lengths of conductor lines each connecting the first to fourth capacitances to the first to sixth resonators are generally equal, so that they can be patterned without changing the resonant frequency of the first to sixth resonators. Accordingly, the passband generated by magnetic coupling between adjacent resonators in the second to sixth resonators can be tuned in the range of 3.16 GHz-4.75 GHz. In addition, it is also possible to form an attenuation pole on the higher frequency side so as to be in the vicinity of 5.3 GHz by the combination between the second to fifth resonators and the first to fourth capacitances and the capacitance formed between the input terminal electrode and the output terminal electrode. Meanwhile, since an attenuation pole can be formed in the vicinity of 2.3 GHz on the lower frequency side, bandpass characteristics and attenuation characteristics required for use in UWB can be realized with high performance. Owing to this feature, deterioration of the communication quality due to interference with 2.48 GHz W-LAN and 5.15 GHz W-LAN can be reduced.

The bandpass filter according to the present invention is preferably arranged such that grounded ends of the first resonator and the sixth resonator are disposed at locations shifted by predetermined distances from the locations of the grounded ends of the second to fifth resonators, and a part of the first resonator in proximity to the ungrounded end thereof bends toward the second resonator, and a part of the sixth resonator in proximity to the ungrounded end thereof bends toward the fifth resonator.

With this structure, the distances between the ungrounded ends of all of the first to sixth resonators and capacitances (the first to fourth capacitances) to be connected to the ungrounded ends can be minimized, and adjusting the passband frequencies and adjusting the attenuation pole frequencies are facilitated. Incidentally, since the magnetic coupling between the first resonator and second resonator and the magnetic coupling between the fifth resonator and sixth resonator are weak, even when the grounded ends are shifted toward the side of the ungrounded ends without changing the lengths of the first and sixth resonators, no significant influence is exerted on the characteristics of the bandpass filter.

The bandpass filter according to the present invention is preferably arranged such that a part of the second resonator in proximity to the ungrounded end thereof bends toward the first resonator, and a part of the fifth resonator in proximity to the ungrounded end thereof bends toward the sixth resonator. Furthermore, it is preferable that a part of the third resonator in proximity to the ungrounded end thereof bends toward the first resonator, and a part of the fourth resonator in proximity to the ungrounded end thereof bends toward the sixth resonator.

This arrangement allows the locations of the capacitances (the first to fourth capacitances) to be freely adjusted, and facilitates control of the characteristics of the bandpass filter. In addition, since it is possible to form the first capacitance between the first resonator and second resonator, the second capacitance between the first resonator and third resonator, the third capacitance between the fourth resonator and sixth resonator, and the fourth capacitance between the fifth resonator and sixth resonator, miniaturization of the bandpass filter can be accomplished.

The bandpass filter according to the present invention is preferably arranged such that the capacitances comprise capacitances created in the stacking direction by conductor patterns provided on different dielectric layers being opposed to each other, and a first capacitance is formed between a conductor pattern connected to the ungrounded end of the first resonator and a conductor pattern connected to the ungrounded end of the second resonator, a second capacitance is formed between a conductor pattern connected to the ungrounded end of the first resonator and a conductor pattern connected to the ungrounded end of the third resonator, a third capacitance is formed between a conductor pattern connected to the ungrounded end of the sixth resonator and a conductor pattern connected to the ungrounded end of the fourth resonator, and a fourth capacitance is formed between a conductor pattern connected to the ungrounded end of the sixth resonator and a conductor pattern connected to the ungrounded end of the fifth resonator.

By forming the first to fourth capacitances on layers different from the layer on which the first to sixth resonators are provided, occurrence of magnetic coupling between the capacitances and resonators can be suppressed, so that good characteristics can be achieved. In addition, since the first to fourth capacitances can be formed on a plurality of layers through the via hole conductors, any desired capacitance can be created, facilitating control of the passband and attenuation poles of the bandpass filter.

In particular, the bandpass filter according to the present invention is preferably arranged such that the first capacitance is formed by disposing the conductor pattern connected to the ungrounded end of the second resonator on and under the conductor pattern connected to the ungrounded end of the first resonator, the second capacitance is formed by disposing the conductor pattern connected to the ungrounded end of the third resonator on and under the conductor pattern connected to the ungrounded end of the first resonator, the third capacitance is formed by disposing the conductor pattern connected to the ungrounded end of the fourth resonator on and under the conductor pattern connected to the ungrounded end of the sixth resonator, and the fourth capacitance is formed by disposing the conductor pattern connected to the ungrounded end of the fifth resonator on and under the conductor pattern connected to the ungrounded end of the sixth resonator.

By this arrangement, the coupling among the second to fifth resonators can be strengthened, so that a wide passband can be easily realized.

The bandpass filter according to the present invention is preferably arranged such that an upper ground electrode and a lower ground electrode are provided so as to vertically sandwich the first to sixth resonators, and the first to fourth capacitances in the stacking direction.

By vertically sandwiching by the grounded electrodes, magnetic coupling with external noises can be prevented, and the bandpass filter with a strong structure that will not be a source of interference with the outside can be realized.

Furthermore, the bandpass filter according to the present invention is preferably arranged such that the input terminal electrode and the output terminal electrode are electrically coupled with each other by being connected to each other through a capacitance.

Because of the electric coupling between the input terminal electrode and the output terminal electrode, at a frequency at which the phase of a signal passing through this capacitance and the phase of a signal passing through the circuit comprising the input capacitance, the first to sixth resonators, the first to fourth capacitances and the input/output capacitance differ by 180°, the signals cancel each other to form an attenuation pole. By this phenomenon, the attenuation pole on the lower frequency side is shifted toward the passband, and a part of the attenuation pole on the higher frequency side is shifted toward the passband, so that a steeper attenuation characteristic can be obtained.

Specifically, it is preferable that the capacitances comprise capacitances formed in the stacking direction by conductor patterns each provided on different dielectric layers being opposed to each other, and independent conductor patterns are formed on layers that are different from the layer on which the conductor pattern connected to the input terminal electrode is provided and the layer on which the conductor pattern connected to the output terminal electrode is provided.

In the above described manner, independent conductor patterns are opposed to the conductor pattern connected to the input terminal electrode and the conductor pattern connected to the output terminal electrode so that series connection of capacitances generated between each of them is realized, which allows the independent conductor patterns to be formed using a uniform pattern. A bandpass filter with a simple structure withstanding layer displacement can therefore be produced.

Another aspect of the present invention is wireless communications equipment including the foregoing bandpass filter. According to this wireless communications equipment, signal receiving sensitivity is improved, and wide passband communications and low power consumption can be realized, as well as mutual interference with other wireless communications equipment such as W-LAN can be prevented.

These and other advantages, features and effects of the present invention will be made apparent by the following description of preferred embodiments with reference to the accompanying drawings.

DETAILED DESCRIPTION OF PREFERRED EMBODIMENT

Hereinafter, specific embodiments of the present invention will be described with reference to the accompanying drawings.

Figure 1:
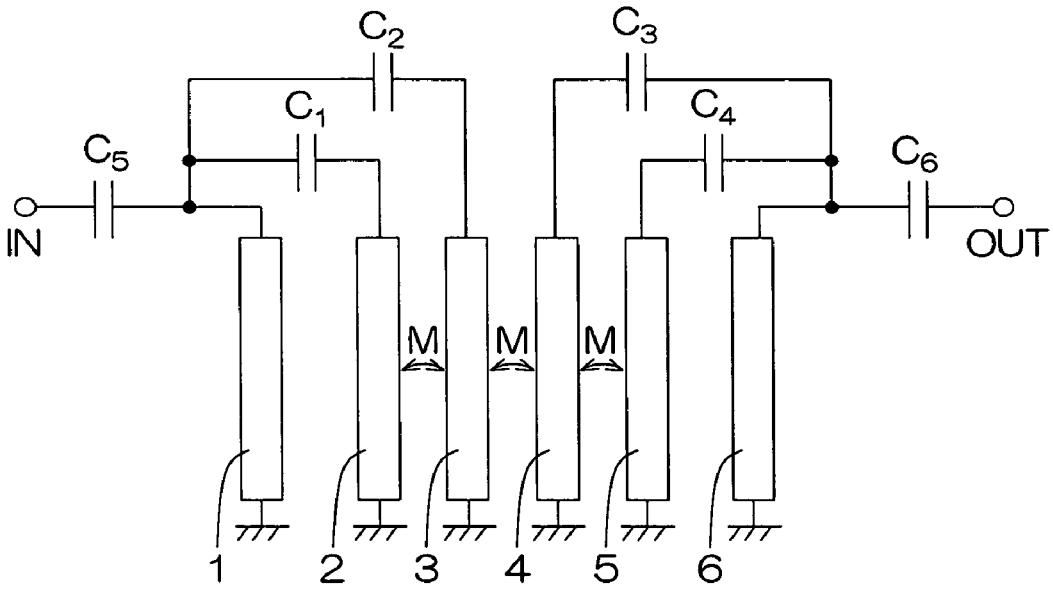
FIG. 1 illustrates an equivalent circuit of a bandpass filter according one embodiment of the present invention.

FIG. 1 shows the circuit structure of a bandpass filter according to one embodiment of the present invention.

The bandpass filter includes vertically stacked six resonators 1-6 (these correspond to first resonator, second resonator, third resonator, fourth resonator, fifth resonator and sixth resonator, respectively). These resonators 1-6 are in the form of rectangular conductor plates, and constituted of strip lines, microstrip lines or coplanar lines. The ungrounded ends of the resonator 1 and resonator 2 are connected to each other through a capacitance C1 (corresponding to first capacitance), the ungrounded ends of the resonator 1 and resonator 3 are connected to each other through a capacitance C2 (corresponding to second capacitance), the ungrounded ends of the resonator 4 and resonator 6 are connected to each other through a capacitance C3 (corresponding to third capacitance), and the ungrounded ends of the resonator 6 and resonator D are connected to each other through a capacitance C4 (corresponding to fourth capacitance).

The lengths of all the foregoing resonators 1-6 are basically $\lambda/4$, respectively, when the propagation wavelength inside the dielectric layer at a generally center frequency of the passband is represented by $\lambda$.

In the six resonators, at least four resonators 2-5 are arranged in parallel to each other on the surface of the same dielectric.

However, they may be arranged not on the surface of the same dielectric but in an overlapping manner when viewed from the stacking direction.

By this arrangement, four resonators 2-5 are electromagnetically coupled with each other, and in particular, magnetic coupling among these is strong (shown by M in FIG. 1).

The end portions of the six resonators 1-6 on the other side (the lower side in FIG. 1) are each grounded (referred to as "grounded end")

The ungrounded ends of the resonators 1, 6 are electrically coupled with an input electrode IN and an output electrode OUT through an input capacitance C5 and an output capacitance C6, respectively. These electrically coupled sections are referred to as "input section" and "output section"

The input/output capacitances C5, C6 constituting the input section and output section, respectively, may be concentrated constant circuits or distributed constant circuits.

By the structure described above, mutual inductance coupling M between the resonators 2-5 is strengthened, increasing the coupling coefficient, so that the passband can be expanded.

In addition, by arranging the four resonators 2-5 so as to be opposed to each other, miniatuarization of the bandpass filter can be accomplished.

The capacitances of the foregoing input/output capacitances C5, C6 are preferably at least 0.5 pF and less than 1.5 pF.

Because of relatively narrow passbands of conventional bandpass filters, high values are desired for circuits Q, Qe that indicate steepness of circuits.

Accordingly, when input and output loads are electrically coupled with the filter circuit, since Qe is a function of the reciprocal of capacitance, the capacitance is as small as 0.1 pF or less.

On the other hand, since a bandpass filter according to the present invention requires a bandwidth of about 1.5 GHz or more, the value of Qe is desirably small. Accordingly, a capacitance as large as 0.5 pF or more is required for the foregoing capacitances.

Meanwhile, when the capacitances of the foregoing capacitances are too great, although the passband becomes wider, the attenuation loses steepness. Since a steep attenuation characteristic is required in a narrow passband of 0.4 GHz-0.6 GHz for a bandpass filter used for UWB, too great capacitances are inappropriate for the foregoing capacitances in view of attenuation characteristic.

Figure 18:
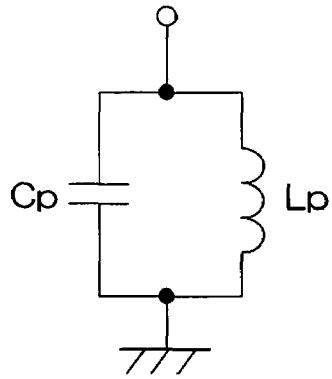
FIG. 18 a diagram showing an equivalent circuit in the vicinity of the resonant frequency of a resonator whose one end is grounded.
Figure 19:
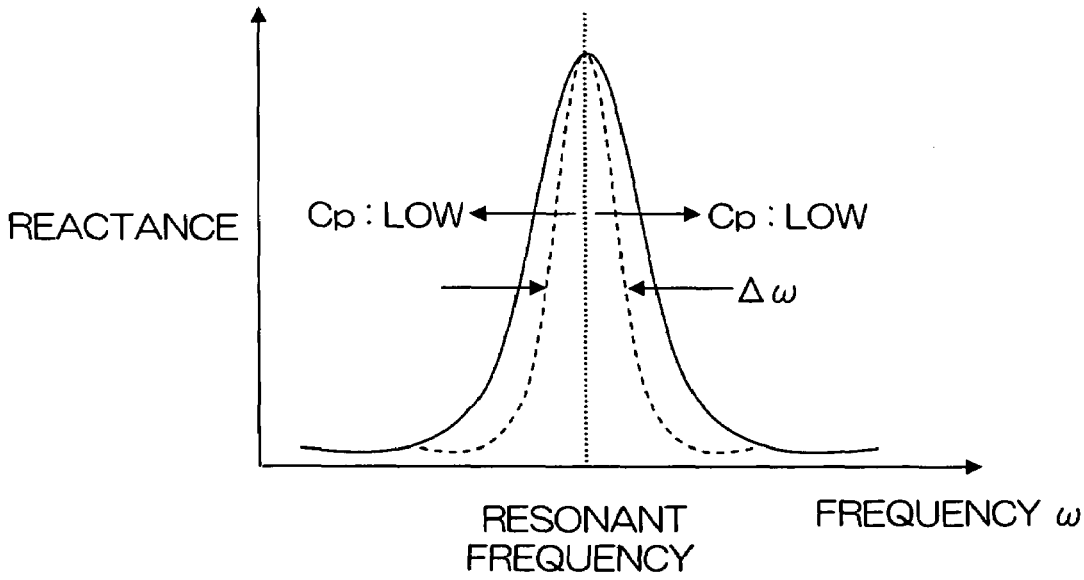
FIG. 19 is a graph showing reactance in the vicinity of the resonant frequency of a resonator whose one end is grounded.

The dielectric constant of the foregoing dielectric is preferably determined to be 10 or less at 3.1 GHz-10.6 GHz in UWB. Generally, a resonator in the vicinity of the resonant frequency can be depicted equivalently as a circuit in which an equivalent inductance Lp and an equivalent capacitance Cp are connected in parallel as in FIG. 18. The Q of the resonator at this stage is proportional to a frequency X and the capacitance of the equivalent capacitance Cp. When a dielectric with a high dielectric constant is used, the equivalent capacitance Cp becomes great and the Q of the resonator is increased. Since a higher Q of the resonator means a narrower passband of the resonator, the passband of a bandpass filter using a resonator with high Q is bound to be narrow. This is shown as a graph in FIG. 19 revealing that when the resonant frequency is constant, the smaller the Cp, the wider the passband. Therefore, the dielectric constant is preferably 10 or less.

Figure 2:
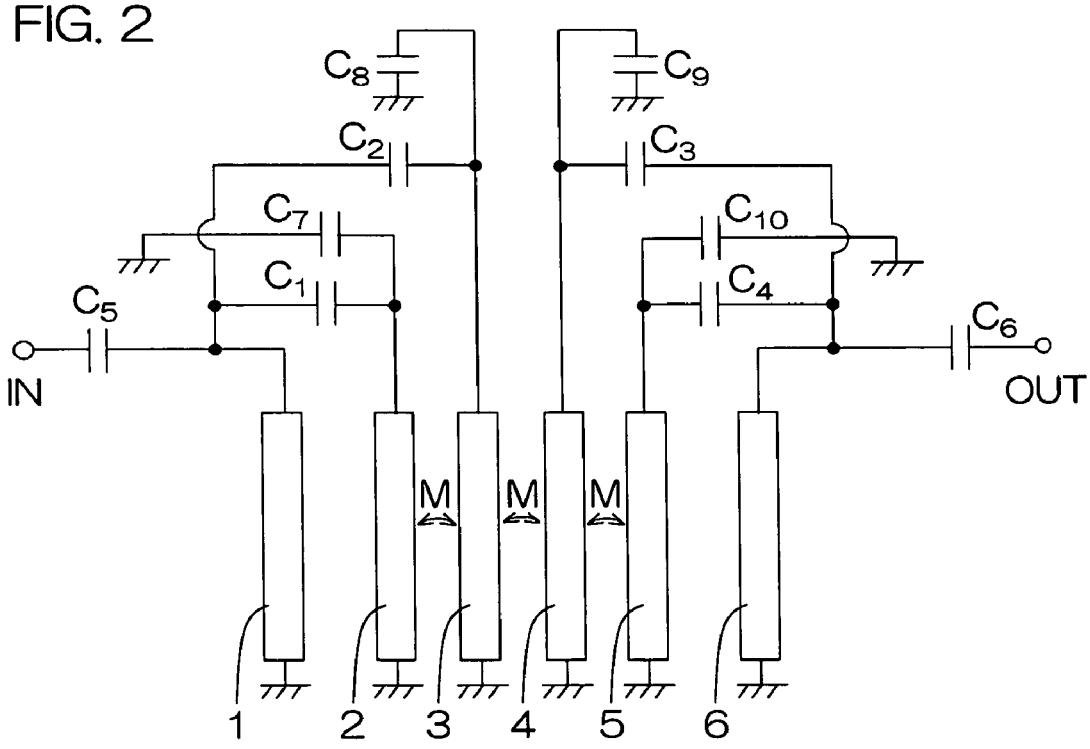
FIG. 2 illustrates an equivalent circuit of a bandpass filter according to another embodiment of the present invention.

FIG. 2 shows a structure different from that of FIG. 1, the ungrounded ends of resonators 2-5 are electrically coupled with an input electrode IN and an output electrode OUT through capacitances C1-C4, respectively, and the ungrounded ends of resonators 2-5 are grounded through capacitances C7-C10, respectively.

That is, the ungrounded end of a resonator 2 is grounded through a capacitance C7, the ungrounded end of a resonator 3 is grounded through a capacitance C8, the ungrounded end of a resonator 4 is grounded through a capacitance C9, and the ungrounded end of a resonator 5 is grounded through a capacitance C10.

Meanwhile, the capacitances C7-C10 may be of concentrated constant or distributed constant.

When this structure is compared with FIG. 1, the ungrounded ends of the resonators 2-5 are grounded through the capacitances C7-C10. This allows a part of the effective lengths of the resonators 2-5 to be substituted by the capacitances C7-C10, so that the lengths of the resonator 2-5 can be less than ¼ wavelength.

As a result, in this bandpass filter, the lengths of the resonator 2-5 can be shortened, which is more advantageous for miniaturization.

Figure 3:
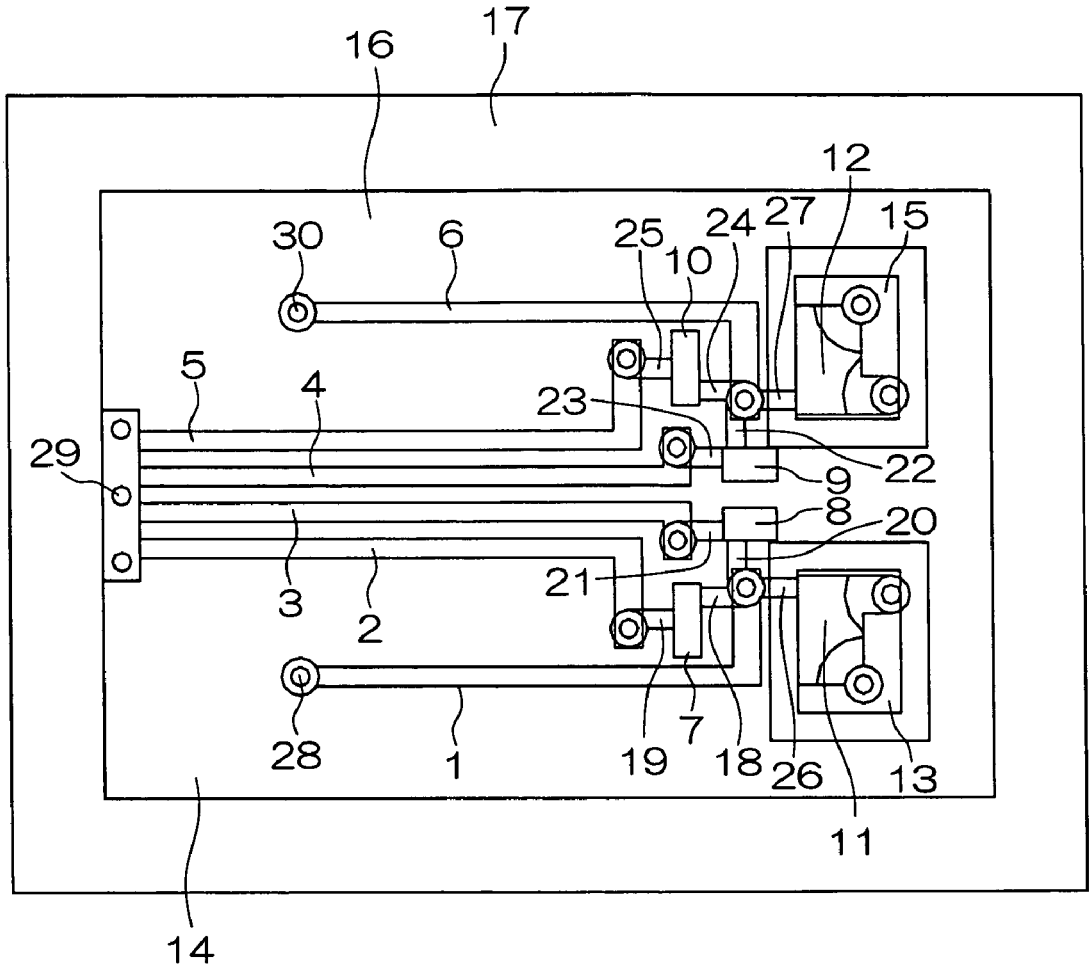
FIG. 3 is a perspective view of the bandpass filter shown in FIG. 2 as viewed in the stacking direction, where conductor patterns deposited on different layers of a multilayer body including a plurality of dielectric layers are shown in an overlapping manner.

FIG. 3 shows an example of the structure of the bandpass filter in FIG. 2. This is a perspective view of a plurality of dielectric layers viewed from the stacking direction, where conductive patterns formed on different dielectric layers are shown in a overlapping manner.

FIGS. 4A-4H and FIGS. 5A-5E illustrate the bandpass filter shown in FIG. 3 showing developed views of dielectric layers one by one, where FIGS. 4A-4H show layers from the surface layer to the eighth layer, and FIGS. 5A-5E show layers from the ninth layer to the twelfth layer and the backside surface.

This bandpass filter comprises, for example, a multilayer body including a plurality of dielectric layers 17 with dielectric coefficient of about 5.0-60, thickness of 0.03-0.1 mm, and the structure of the multilayer body includes via hole conductors penetrating the dielectric layers and conductor patterns formed on the dielectric layers 17.

This embodiment, as shown in FIGS. 4A-4H and FIGS. 5A-5E, comprises twelve dielectric layers.

Figure 4A:
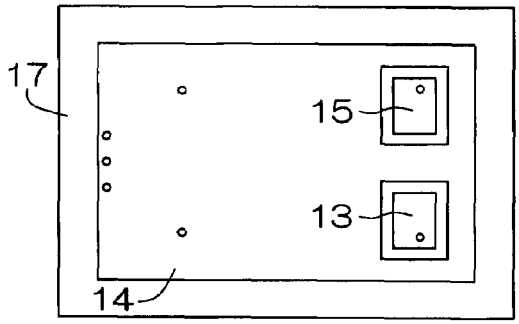
FIGS. 4A-4H illustrate the bandpass filter shown in FIG. 3 viewed from top showing developed views of dielectric layers from the surface layer to the eighth layer.
Figure 4B:
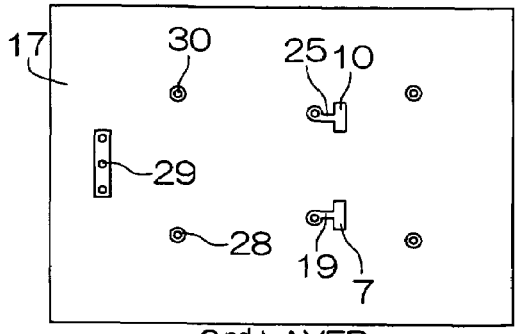
Figure 4C:
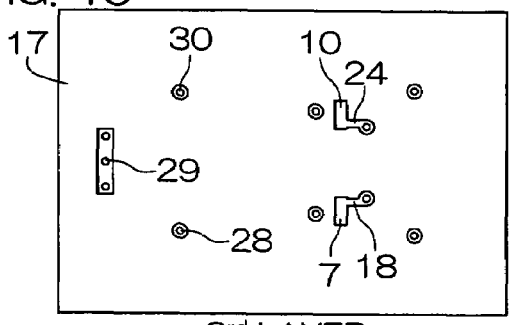
Figure 4D:
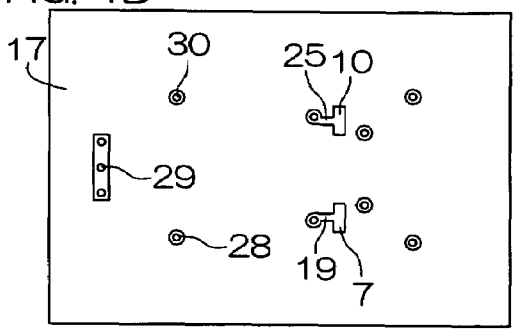
Figure 4E:
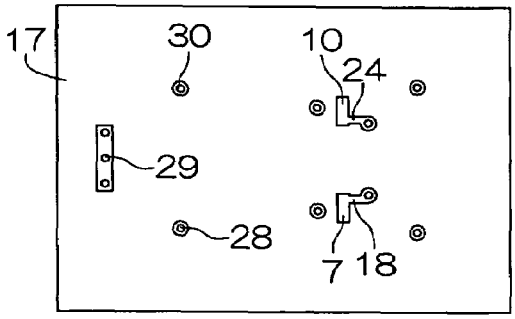
Figure 4F:
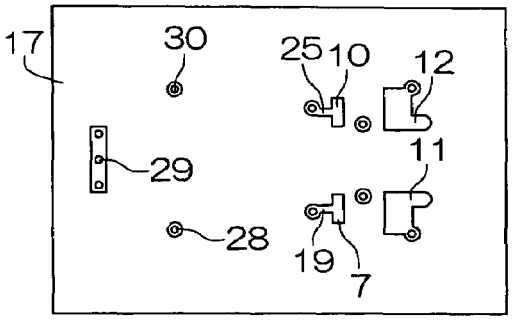
Figure 5A:
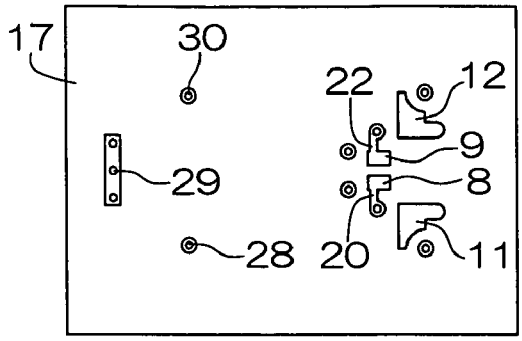
FIGS. 5A-5E illustrate the bandpass filter shown in FIG. 3 viewed from top showing developed views of dielectric layers from the ninth layer to the twelfth layer, and the backside surface.
Figure 5B:
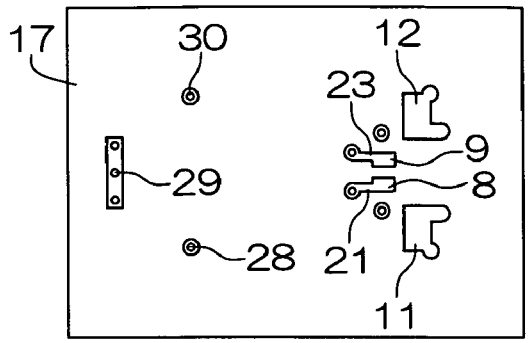
Figure 5C:
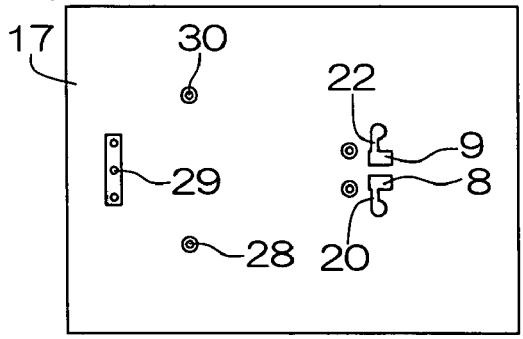
Figure 5D:
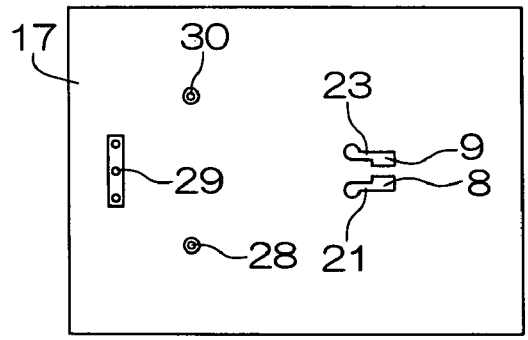
Figure 5E:
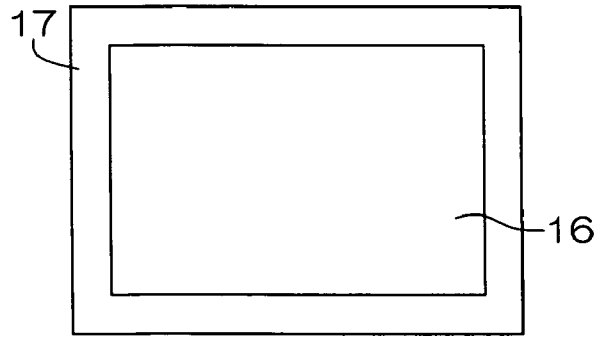

On the surface of the multilayer body (on the dielectric layer as the surface layer) an input terminal electrode 13 and an output terminal electrode 15 are provided, as well as a ground pattern 14 as upper side ground electrode is provided (FIG. 4A). On the backside surface of the multilayer body, a ground pattern 16 as lower side ground electrode is provided (FIG. 5E).

Figure 4G:
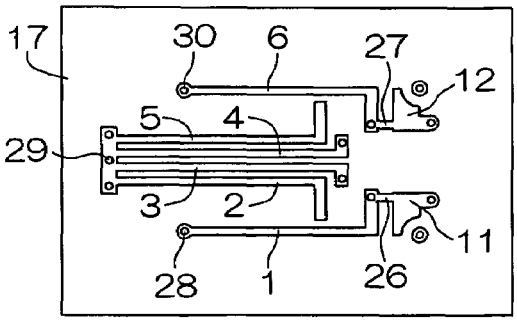
Figure 4H:
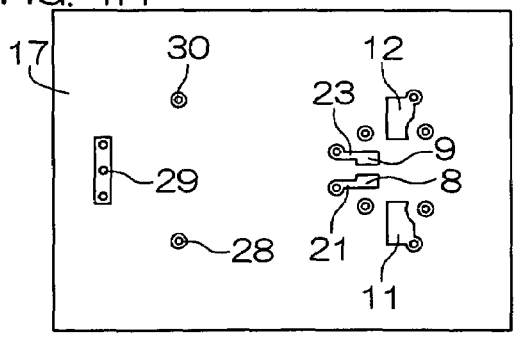

In addition, six resonators (resonator 1, resonator 2, resonator 3, resonator 4, resonator 5 and resonator 6) each having one end being grounded as grounded end, each of which comprises a conductor pattern whose length in the signal propagation direction is basically λ/4 when the propagation wavelength inside the dielectric layer at a generally center frequency of the passband is-represented by λ, are formed on the same dielectric layer (on the 7th dielectric layer) inside the multilayer body (FIG. 4G).

The respective grounded ends of these six resonators are arranged in the same direction when viewed from the stacking direction and juxtaposed in sequence from resonator 1 to resonator 6. That is, they are provided in the following order: resonator 1, resonator 2, resonator 3, resonator 4, resonator 5, and resonator 6.

Meanwhile, the length in the signal propagation direction is "basically λ/4" indicates that there are cases where the length is less than λ/4 as a result of varying the capacitance of the ungrounded end with respect to the ground surface.

One end (grounded end) of the resonator 1 is connected to a ground pattern 14 formed on the surface of the multilayer body and a ground pattern 16 formed on the backside surface of the multilayer body through a via hole conductor 28. The ungrounded end of the resonator 1 is connected to the input terminal electrode 13 through the input capacitance C5.

Specifically, the ungrounded end of the resonator 1 is connected to a conductor pattern 11 formed on the seventh dielectric layer through a conductor line 26, and the conductor pattern 11 on the seventh dielectric layer is connected to a conductor pattern 11 on the ninth dielectric layer through a via hole conductor.

The input terminal electrode 13 is connected to conductor patterns 11 on the sixth, eighth and tenth dielectric layers through a via hole conductor. The conductor patterns 11 formed on the respective dielectric layers overlap each other when viewed in the stacking direction, so that they function as input capacitance C5 that creates capacitance in the stacking direction.

One end (grounded end) of the resonator 6 is connected to a ground pattern 14 formed on the surface of the multilayer body and a ground pattern 16 formed on the backside surface of the multilayer body through a via hole conductor 30.

The ungrounded end of the resonator 6 is connected to the output terminal electrode 15 through the output capacitance C6. Specifically, the ungrounded end of the resonator 6 is connected to a conductor pattern 12 formed on the seventh dielectric layer through a conductor line 27, and the conductor pattern 12 on the seventh dielectric layer is further connected to a conductor pattern 12 on the ninth dielectric layer through a via hole conductor.

In addition, the output terminal electrode 15 is connected to conductor patterns 12 on the sixth, eighth and tenth dielectric layers through a via hole conductor. The conductor patterns 12 formed on the respective dielectric layers overlap each other when viewed in the stacking direction, so that they function as output capacitance C6 that creates capacitance in the stacking direction.

For the formation of the input capacitance C5 and output capacitance C6, while various structures may be employed for creating capacitance in the stacking direction, it is preferably a structure as this embodiment in which conductor patterns to be connected to the input terminal electrode 13 and output terminal electrode 15 are disposed in the upper and lower most surfaces thereby to create capacitance. Incidentally, the connection may be accomplished not only through capacitance but also through inductance.

One ends (grounded ends) of the resonators 2-5 are interconnected, and further connected to the ground pattern formed in the backside surface of the multilayer body through a via hole conductor 29.

In addition, while resonators adjacent to each other in the resonators 2-5 are arranged at intervals so that they are coupled mainly by inductance coupling, the distances between the resonator 1 and resonator 2 and between the resonator 5 and resonator 6 are larger than the distance between adjacent resonators of the resonators 2-5, and the coupling between them is weak inductance coupling.

The ungrounded ends of the resonator land resonator 3 are connected to each other through the capacitance C1 so that they are electrically coupled with each other.

Specifically, the ungrounded end of the resonator 1 is connected to conductor lines 18 on the fifth and third dielectric layers through a via hole conductor, and the conductor lines 18 are further connected to conductor patterns 7 constituting the capacitance C1.

Meanwhile, the ungrounded end of the resonator 2 is connected to conductor lines 19 on the second, fourth and sixth dielectric layers through a via hole conductor, and the conductor lines 19 are further connected to the conductor patterns 7 constituting the capacitance C1.

As described above, the capacitance C1 is preferably arranged such that capacitance is created in the stacking direction by conductor patterns provided on different dielectric layers being opposed to each other. In this embodiment, the structure is such that conductor patterns 7 on the second and fourth dielectric layers connected to the ungrounded end of the resonator 2 are disposed on and under the conductor pattern 7 on the third dielectric layer connected to the ungrounded end of the resonator 1, as well as the conductor patterns 7 on the fourth and sixth dielectric layers connected to the ungrounded end of the resonator 2 are disposed on and under the conductor pattern 7 on the fifth dielectric layer connected to the ungrounded end of the resonator 1.

Similarly, the ungrounded ends of the resonator 1 and resonator 3 are connected to each other through the capacitance C2, by which they are electrically coupled with each other.

Specifically, the ungrounded end of the resonator 1 is connected to conductor lines 20 on the ninth and eleventh dielectric layers through a via hole conductor, and the conductor lines 20 are further connected to conductor patterns 8 constituting the capacitance C2.

In addition, the ungrounded end of the resonator 3 is connected to conductor lines 21 on the eighth, tenth and twelfth dielectric layers through a via hole conductor, and the conductor lines 21 are further connected to the conductor patterns 8 constituting the capacitance C2.

As described above, the capacitance C2 is preferably arranged such that capacitance is created in the stacking direction by conductor patterns provided on different dielectric layers being opposed to each other. In this embodiment, the structure is such that conductor patterns 8 on the eighth and tenth dielectric layers connected to the ungrounded end of the resonator 3 are disposed on and under the conductor pattern 8 on the ninth dielectric layer connected to the ungrounded end of the resonator 1, as well as the conductor patterns 8 on the tenth and twelfth dielectric layers connected to the ungrounded end of the resonator 3 are disposed on and under the conductor pattern 8 on the eleventh dielectric layer connected to the ungrounded end of the resonator 1.

The ungrounded ends of the resonator 6 and resonator 4 are connected to each other through the capacitance C3, by which they are electrically coupled.

Specifically, the ungrounded end of the resonator 6 is connected to conductor lines 22 on the ninth and eleventh dielectric layers through a via hole conductor, and the conductor lines 22 are further connected to conductor patterns 9 constituting the capacitance C3.

Meanwhile, the ungrounded end of the resonator 4 is connected to conductor lines 23 on the eighth, tenth and twelfth dielectric layers through a via hole conductor, and the conductor lines 23 are further connected to the conductor patterns 9 constituting the capacitance C3.

As described above, the capacitance C3 is preferably arranged such that capacitance is created in the stacking direction by conductor patterns provided on different dielectric layers being opposed to each other. In this embodiment, the structure is such that conductor patterns 9 on the eighth and tenth dielectric layers connected to the ungrounded end of the resonator 4 are disposed on and under the conductor pattern 9 on the ninth dielectric layer connected to the ungrounded end of the resonator 6, as well as the conductor patterns 9 on the tenth and twelfth dielectric layers connected to the ungrounded end of the resonator 4 are disposed on and under the conductor pattern 9 on the eleventh dielectric layer connected to the ungrounded end of the resonator 6.

The ungrounded ends of the resonator 6 and resonator 5 are connected to each other through the capacitance C4, by which they are electrically coupled.

Specifically, the ungrounded end of the resonator 6 is connected to conductor lines 24 on the fifth and third dielectric layers through a via hole conductor, and the conductor lines 24 are further connected to conductor patterns 10 constituting the capacitance C4.

Meanwhile, the ungrounded end of the resonator 5 is connected to conductor lines 25 on the second, fourth and sixth dielectric layers through a via hole conductor, and the conductor lines 25 are further connected to the conductor patterns 10 constituting the capacitance C4.

As described above, the capacitance C4 is preferably arranged such that capacitance is created in the stacking direction by conductor patterns provided on different dielectric layers being opposed to each other. In this embodiment, the structure is such that conductor patterns 10 on the second and fourth dielectric layers connected to the ungrounded end of the resonator 5 are disposed on and under the conductor pattern 10 on the third dielectric layer connected to the ungrounded end of the resonator 6, as well as the conductor patterns 10 on the fourth and sixth dielectric layers connected to the ungrounded end of the resonator 5 are disposed on and under the conductor pattern 10 on the fifth dielectric layer connected to the ungrounded end of the resonator 6.

As described above, the capacitances C1-C4 are arranged such that two conductor patterns connected to the ungrounded end of the resonator 1 or resonator 6 are sandwiched by three conductor patterns located on and under them connected to the ungrounded ends of the resonators 2-5, in other words, the conductor patterns connected to the ungrounded ends of the resonators 2-5 are disposed on the upper and lower most surfaces layers, and they are arranged in an overlapping manner when viewed in the stacking direction, so that more capacitance can be created between the conductor patterns, as well as the effect to create the capacitance of the resonators 2-5 is achieved in relation to the ground pattern 14 and ground pattern 16. Incidentally, the number of the layers is not defined specifically, but determined according to the case.

In addition, the ground ends of the resonators 2-5 are aligned so as to be generally in a row with respect to the longitudinal direction (on a line perpendicular to the longitudinal axis), and the ungrounded ends of the resonator 1 and resonator 6 are disposed at positions shifted toward the side of the ungrounded ends from the position of the ground ends of the resonators 2-5 by a predetermined distance.

A part of the resonator 1 in proximity to the ungrounded end bends toward the resonator 2, and a part of the resonator 6 in proximity to the ungrounded end bends toward the resonator 5.

Furthermore, in this embodiment, a part of the resonator 2 in proximity to the ungrounded end bends toward the resonator 1, and a part of the resonator 5 in proximity to the ungrounded end bends toward the resonator 6, a part of the resonator 3 in proximity to the ungrounded end bends toward the resonator 1, and a part of the resonator 5 in proximity to the ungrounded end bends toward the resonator 6.

By the arrangement described above, distances between the ungrounded ends of all the resonators including resonator 1-resonator 6 and the capacitances connected to the ungrounded ends are generally equal when viewed in the stacking direction. In other words, the lengths of the conductor line 18, conductor line 19, conductor line 20, conductor line 21, conductor line 22, conductor line 23, conductor line 24, and conductor line 25 are generally equal.

Since these distances are generally equal when viewed in the stacking direction, the lengths are generally equal including the lengths of conductor lines that connect the capacitances C1-C4 to the resonator 1-resonator 6, respectively, leading to the advantageous effect that patterning can be accomplished without changing the resonant frequency of the resonator 1-resonator 6.

Meanwhile, ungrounded end refers to a region of a pattern extending from the edge on the ungrounded side of a resonator to a distance of 200 μm toward the ground side. Also, "lengths are generally equal" refers to the difference in length of conductor lines between the maximum length and minimum length is 100 μm or less.

Incidentally, although the resonators 2-5 do not need to be bended if the lengths of all the, conductor lines are generally equal, by bending them in the foregoing manner, the locations of the capacitances C1-C4 can be adjusted as desired, thereby facilitating control of the characteristics of the bandpass filter.

Moreover, since it is possible to form the capacitance C1 between the resonator 1 and resonator 2, the capacitance C2 between the resonator 1 and resonator 3, the capacitance C3 between the resonator 4 and resonator 6, and the capacitance C4 between the resonator 5 and resonator 6, miniaturization of bandpass filter can be accomplished.

In this embodiment, the resonators 1-6 and capacitances C1-C4 are formed in a region sandwiched by the ground pattern 14 as upper ground electrode and ground pattern 16 as lower ground electrode.

Sandwiching by the upper and lower ground electrodes in such a manner brings about an advantageous effect that magnetic coupling with noises entering from the outside can be prevented, and that the bandpass filter is prevented from being a source of interference with the outside.

Also, in this embodiment, the capacitances C1-C4 are formed by forming the conductor patterns connected to the ungrounded ends of the resonators 2-5 so as to be opposed to the ground pattern 14 and ground pattern 16 so that they serve also as electrodes of shunt capacitance between the resonators 2-5 and the ground, by which simplification of conductor patterns is intended for.

By the structure describe above, coupling between the resonators 2-5 can be strengthened and a wide passband is easily achieved. The reason for this will be hereinafter described.

The passband of a bandpass filter depends on the coupling coefficient between the resonators. According to a theoretical calculation using the Chebyshev function, when a bandpass filter with a passband of 3.1-4.9 GHz is produced, a coupling coefficient of 0.4 is necessary. The coupling coefficient can be controlled by the distances between resonators disposed in the same layer, and the coupling coefficient can be increased by narrowing the distances.

Figure 14:
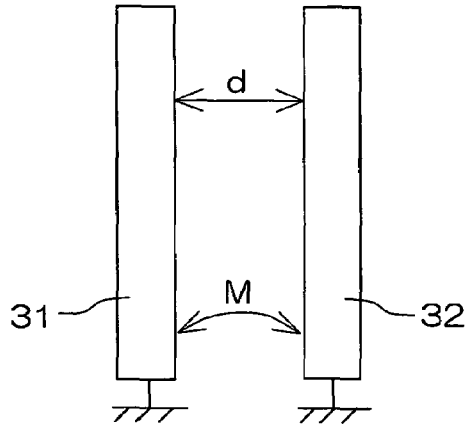
FIG. 14 is a diagram showing an equivalent circuit of a sample on which the relationship between distance between resonators and coupling coefficient is measured.

Two λ/4 strip line resonators 31, 32 whose equivalent circuit is shown in FIG. 14 having a width of 0.1 mm and a length of 3.2 mm were formed in the same layer in a ceramic substrate with a dielectric coefficient of 9.4 and a thickness of 0.9 mm. Variations in coupling coefficient were measured after the distance d between the resonators was varied from 0.075 mm-0.125 mm. In addition, the two strip line resonators were coupled weakly with input and output electrodes by inductance.

Figure 15:
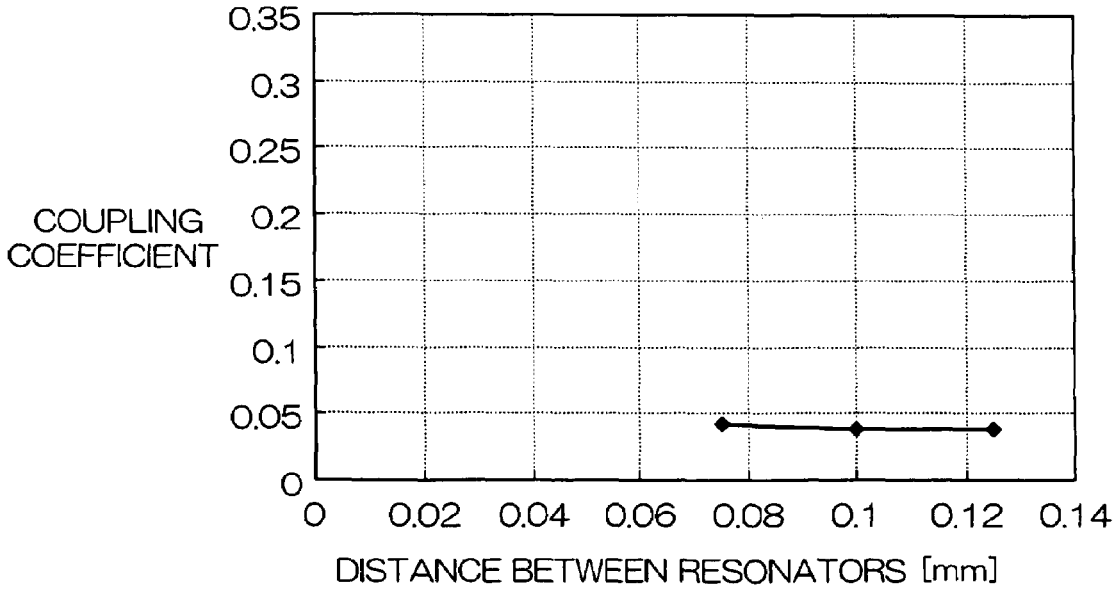
FIG. 15 is a graph showing the result of the measurement of the relationship between distance between resonators and coupling coefficient.

As a result, as shown in FIG. 15, the coupling coefficient was found to be as small as 0.04 at 0.075 mm which was the narrowest distance between the resonators. Although the distance d between the resonators being less than 0.075 mm may be an approach to strengthening the coupling, narrowing the distance d between the resonators leads to a problem in terms of production that it requires strict accuracy for the distance.

Another approach to strengthening the coupling may be increasing the capacitance of the ungrounded ends of the resonators with respect to the ground surface. By increasing the capacitance, the electric field component of a single resonator is concentrated onto the ground surface through the capacitance, by which the coupling between resonators by magnetic field becomes strong, thereby increasing the coupling coefficient.

Figure 16:
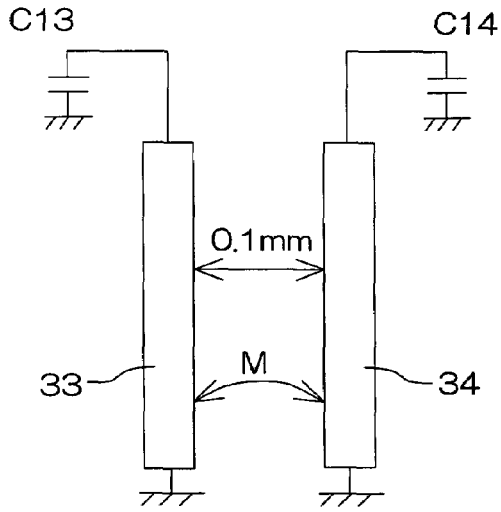
FIG. 16 is a diagram showing an equivalent circuit of a sample on which the relationship between distance between resonators and coupling coefficient is simulated.

Variations in coupling coefficient as a result of varying the capacitance with respect to the ground of λ/4 strip line resonators disposed on the same layer were simulated by Eigenvalue analysis with use of the electromagnetic field simulator HFSS produced by Ansoft Corporation. An equivalent circuit thereof is shown in FIG. 16.

A capacitance C13 and a capacitance C14 are connected to the ungrounded ends of a resonator 3 and a resonator 4, respectively. The simulation was carried out with the following conditions:

dielectric coefficient: 9.4, thickness: 0.9 mm, width of resonators: 0.1 mm, length of resonators: 3.2 mm, and distance d between resonators: 0.1 mm. Here, the capacitances C13 and C14 were calculated using the equation for calculating the capacitance of parallel plate, which were determined by electrode area and distance to the GND surface.

Figure 17:
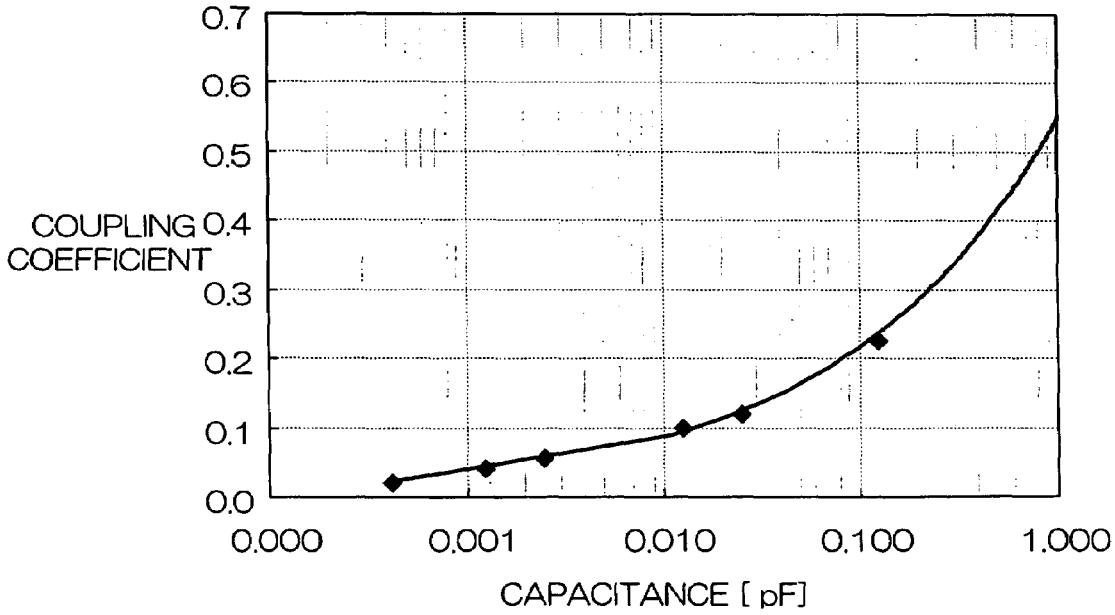
FIG. 17 shows the result of the simulation of the relationship between distance between resonators and coupling coefficient.

The results revealed, as shown in FIG. 17, that coupling coefficient could be increased by increasing the capacitances C13, C14, and a coupling coefficient of 0.4 was obtained with a capacitance of about 0.2 pF.

In the present invention, as shown in FIG. 2, the capacitances C7-C10 are connected to the resonators 2-5. By this arrangement, the capacitance C7 of the resonator 2 is created between the conductor patterns constituting the capacitance C1 and the ground, the capacitance C8 of the resonator 3 is created between the conductor patterns constituting the capacitance C2 and the ground, the capacitance C9 of the resonator 4 is created between the conductor patterns constituting the capacitance C3 and the ground, and the capacitance C10 of the resonator 5 is created between the conductor patterns constituting the capacitor C4 and the ground.

Accordingly, there is no need to additionally provide capacitances C7-C10 as chip components, by which production of the filter is facilitated.

Furthermore, this arrangement can prevent each of the capacitance C1 and capacitance C2 connected to the resonator 1, and the capacitance C3 and capacitance C4 connected to the resonator 6 from being electromagnetically coupled with the other electrode pattern.

Figure 6:
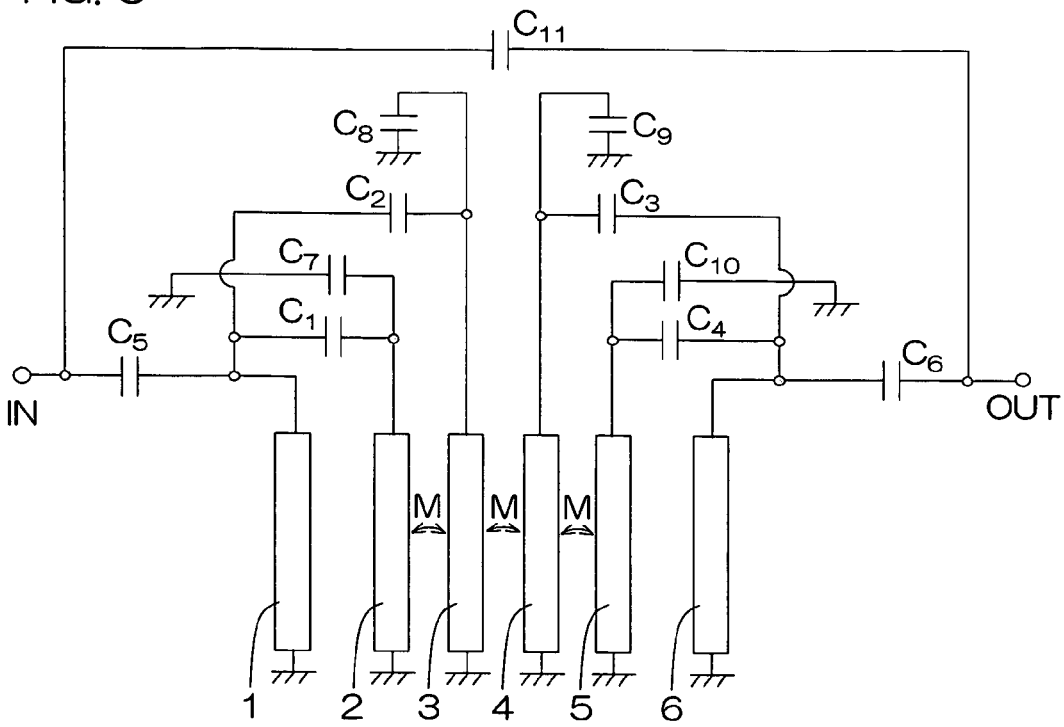
FIG. 6 shows an equivalent circuit of a bandpass filter according to another embodiment of the present invention.

In the equivalent circuit shown in FIG. 6, additionally to the structure in FIG. 2, an input terminal IN and an output terminal OUT are electrically coupled by being connected to each other through a capacitance C11. This circuit is arranged such that an input/output capacitance C11 is interposed between the input terminal IN and output terminal OUT shown in FIG. 2 so as to connect them to each other.

A function of the structure in FIG. 6 is described as follows: a signal passing through a circuit formed from an input capacitance C5 through resonators 1-6 and stage capacitances C1-C4 to an output capacitance C6 and a signal passing through an input/output capacitance C11 cancel each other out to form an attenuation pole at a frequency at which the difference between the signals in phase is 180°.

It is possible to move the attenuation pole on the lower frequency side generated by a parallel resonance phenomenon between the magnetic coupling M between the resonator 1 and resonator 2 and the capacitance C1 to the side of the passband, and to move the attenuation pole on the higher frequency side generated by a resonance phenomenon among the capacitance C1, the inductance coupling M between the resonator 2 and resonator 3 and the resonator 2, and a resonance phenomenon among the capacitance C2, the inductance coupling M between the resonator 3 and resonator 4 and the resonator 3 to the side of the passband. Thus, steeper attenuation characteristics can be obtained.

This input/output capacitance C11 is formed such that a capacitance is created in the stacking direction by conductor patterns provided on different dielectric layers being opposed to each other. Specifically, an independent conductor pattern is provided on a layer different from a layer on which a conductor pattern connected to the input terminal electrode is formed and a layer on which a conductor pattern connected to the output terminal electrode is formed so that the independent conductor pattern is opposed to the conductor pattern connected to the input terminal electrode and the conductor pattern connected to the output terminal electrode, and thereby to accomplish a series connection of the capacitances created among the respective patterns.

Figure 7:
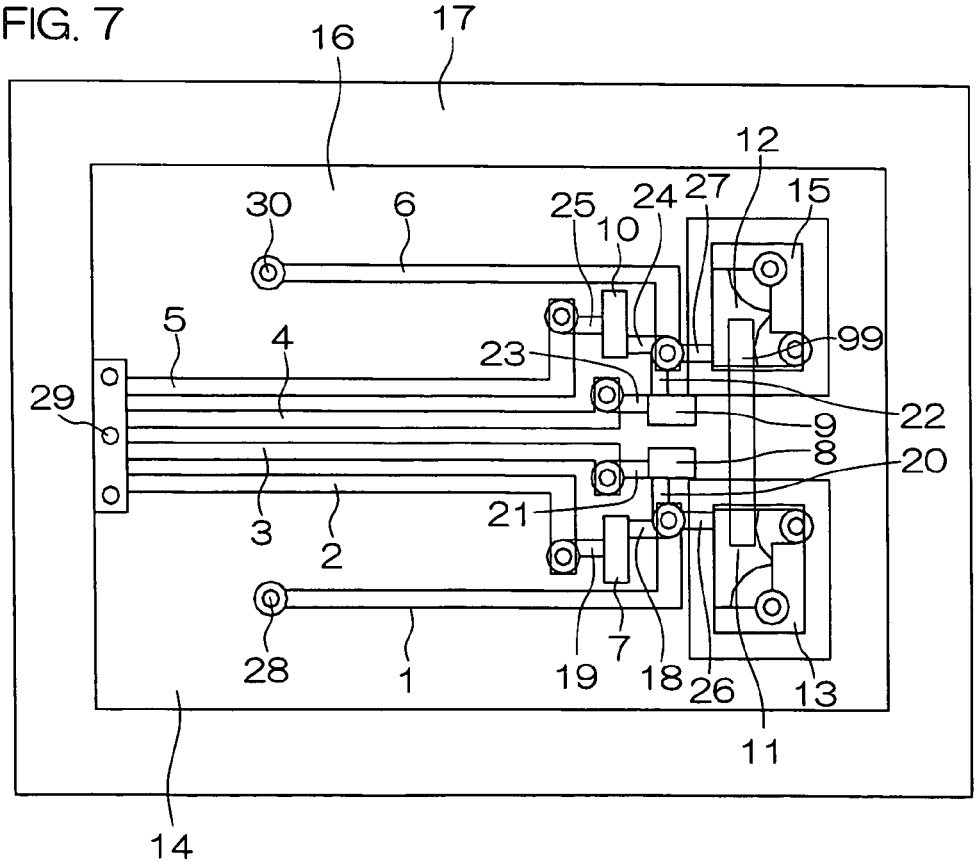
FIG. 7 is a perspective view of the bandpass filter shown in FIG. 6 as viewed in the stacking direction, where conductor patterns deposited on different layers of a multilayer body including a plurality of dielectric layers are shown in an overlapping manner.
Figure 8A:
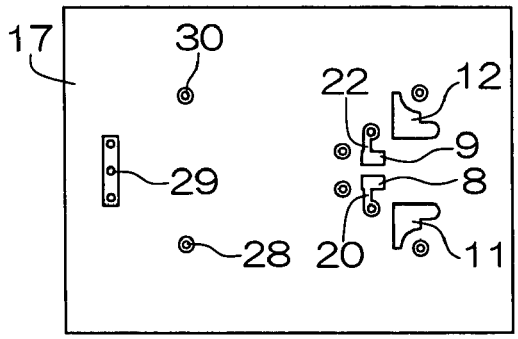
FIGS. 8A-8E illustrate the bandpass filter shown in FIG. 7 viewed from top showing developed views of dielectric layers from the ninth layer to the twelfth layer, and the backside surface.
Figure 8B:
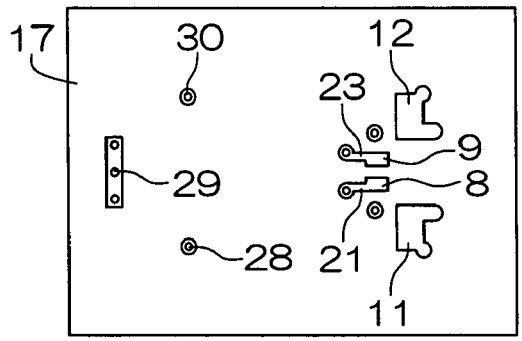
Figure 8C:
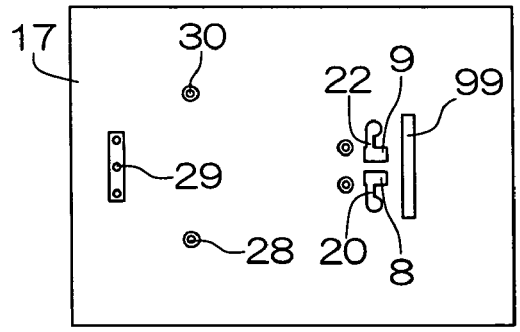
Figure 8D:
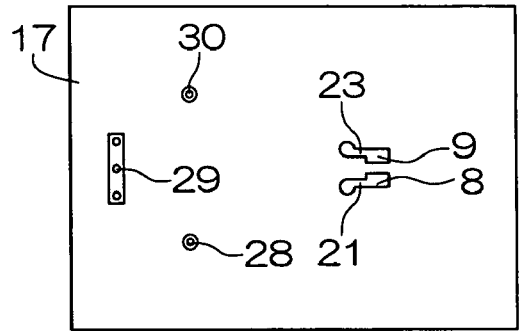
Figure 8E:
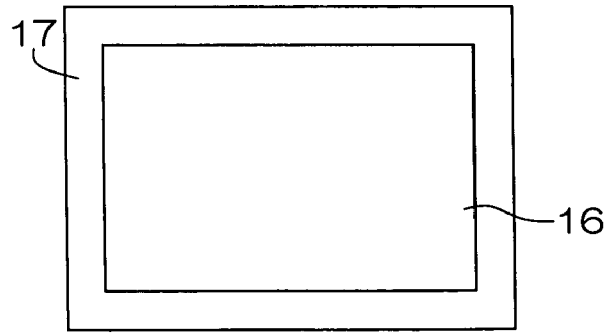

An example of this structure is shown in FIG. 7. FIG. 7 is a perspective view from the stacking direction showing overlapping conductor patterns formed on different layers of a multilayer body comprising a plurality of dielectric layers.

FIGS. 8A-8E illustrate the bandpass filter shown in FIG. 7 showing developed views of the dielectric layers one by one, including the ninth layer to twelfth layer and the backside surface. Meanwhile, since the first to eighth layers of the bandpass filter in FIG. 7 are the same as those shown in FIG. 4A-4H, they are not shown.

As shown in FIGS. 8A-8E, a conductor pattern 99 is disposed on the eleventh layer so that it is coupled with a conductor pattern 11 on the tenth layer and a conductor pattern 12 on the tenth layer. Incidentally, the aforementioned independent conductor pattern refers to a conductor pattern as the conductor pattern 99 that is not electrically connected to any other conductor pattern.

Since the conductor pattern 11 on the tenth layer is connected to an input terminal electrode 13 through a via hole conductor and the conductor pattern 12 on the tenth layer is connected to an output terminal electrode 15 through a via hole conductor, it corresponds to establishing a electric coupling between the input terminal electrode 13 and output terminal electrode 15 by the conductor pattern 99 on the eleventh layer.

The capacitance in this case is a series capacitance composed of-the capacitance created by the conductor pattern 11 and conductor pattern 99 and the capacitance created by the conductor pattern 12 and the conductor pattern 99.

Hereinafter, a process of producing the bandpass filter described referring to FIGS. 1-8 will be described.

The bandpass filter has a structure comprising a multilayer dielectric substrate which includes a plurality of dielectric layers stacked one upon another, and the foregoing resonators formed on the dielectric layers.

The multilayer dielectric substrate comprises a plurality of dielectric layers with a uniform size and shape stacked one upon another, and a conductor layer comprising predetermined conductor patterns is formed on each of the dielectric layers.

Each of the dielectric layers, for example, the dielectric layer is formed using LTCC (Low Temperature Co-fired Ceramics), and the conductor layer on each of the dielectric layers is formed using a low resistance conductor such as copper or silver.

Such a multilayer substrate is formed by a known ceramic multilayer technique, for example, in such a way that conductor paste is applied to the surface of a ceramic green sheet, then the respective conductor patterns constituting the resonators and capacitances are formed and then stacked and thermocompression bonded at a predetermined pressure and temperature, and then fired.

In addition, via hole conductors penetrating through a plurality of layers that are required for connecting upper and lower conductor layers are formed as needed.

Wireless communications equipment according to the present invention has a structure which, for example, comprises a baseband IC for processing baseband signals, RFIC for processing radio frequency signals, a balun for converting balanced signals and unbalanced signals, the foregoing bandpass filter, a radio frequency switch for switching between signal transmission and signal reception, and an antenna connected in this order, in which the bandpass filter is adapted to pass transmitting and receiving signals within the passband in UWB and steeply attenuate signals outside the passband.

As this wireless communications equipment, cellular phones, external storing devices designed for wireless communications, PC peripheral devices such as printers and scanners, digital TVs, projectors, digital steel cameras, digital video cameras and the like may be recited.

Figure 9:
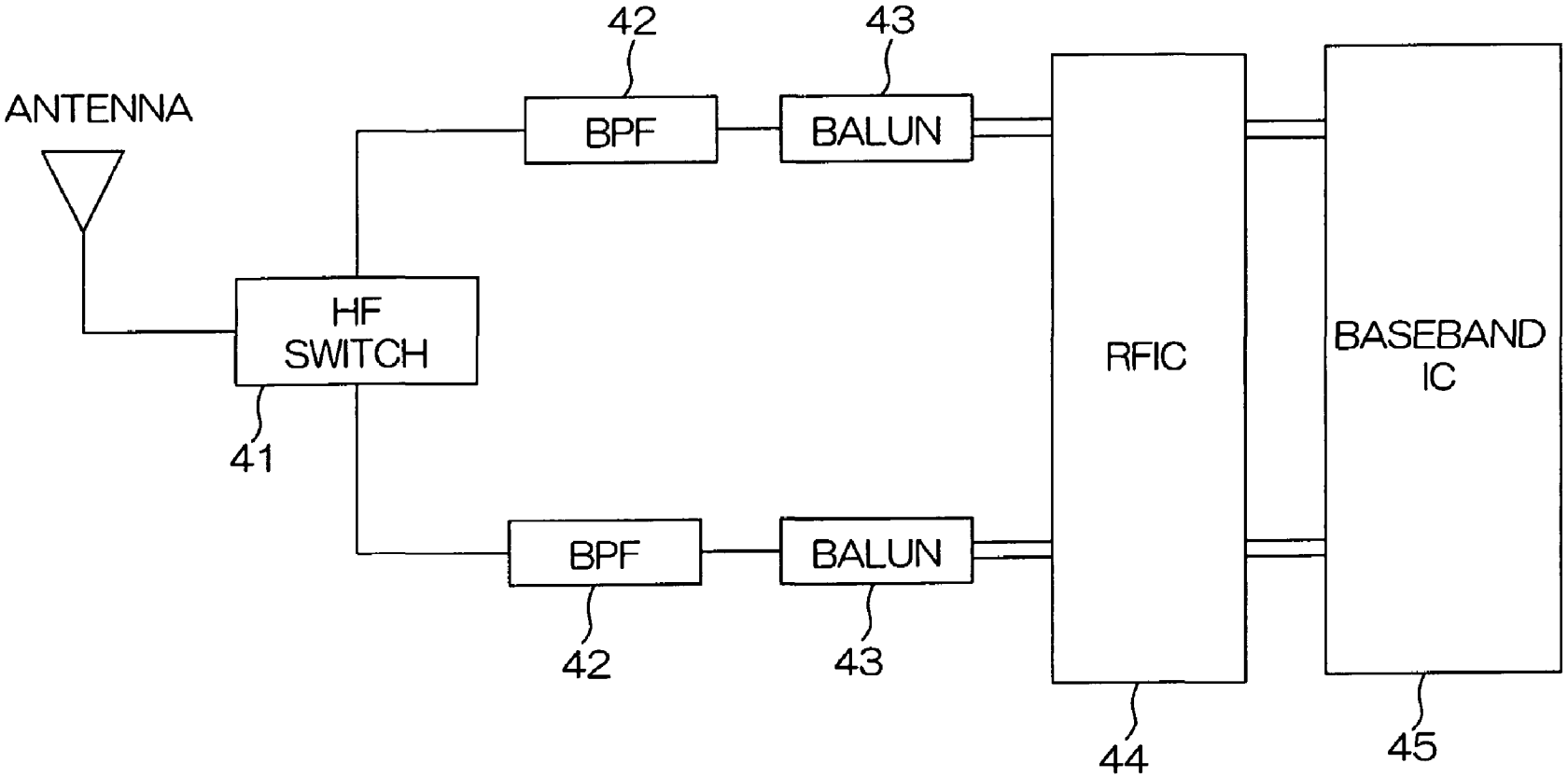
FIG. 9 is a block diagram showing an embodiment of wireless communications equipment including bandpass filters according to the present invention.

Now, the structure of an embodiment of wireless communications equipment incorporating the above-described bandpass filter is shown in FIG. 9.

In FIG. 9, the wireless communications equipment comprises a baseband IC 45 for processing baseband signals, an RFIC 44 for processing radio frequency signals, a radio frequency switch 41 for switching between signal transmission and signal reception, a balun 43 for converting balanced signals and unbalanced signals, a bandpass filter 42 and an antenna.

The foregoing RFIC44 performs frequency conversion and radio frequency amplification of transmission signals taken out from the baseband IC45, while performing low noise amplification of reception signals. The foregoing radio frequency switch 41 performs switching between the transmission and reception paths temporally.

The bandpass filter 42 is a bandpass filter according to the present invention that passes transmission and reception signals within the passband in UWB and sharply attenuates signals outside the passband. Owing to the function of this bandpass filter, transmission and reception signals are not attenuated, and mutual interference with other systems can be prevented.

EXAMPLE

A bandpass characteristic S21 and a reflection characteristic S11 of a bandpass filter fabricated with wiring patterns shown in FIGS. 4A-4H and FIGS. 5A-5E were measured using the vector network analyzer 8719ES produced by Agilent Technologies.

In this case, ceramics with a dielectric coefficient of 9.0 was used, and the dielectric layers consisted of twelve layers and the thickness of each of the dielectric layers was 75 um.

The size of the dielectric was 4.5×3.2 mm. The measured bandpass characteristic S21 and reflection characteristic S11 are shown as a graph in FIG. 10.

In addition, with the conditions being the same, a bandpass characteristic S21 and a reflection characteristic S11 of a bandpass filter additionally comprising a conductor pattern 99 shown in FIGS. 8A-8E, in which the input terminal electrode and output terminal electrode were connected through an input/output capacitance C11 were measured. The results of this are shown in FIG. 11.

Figure 10:
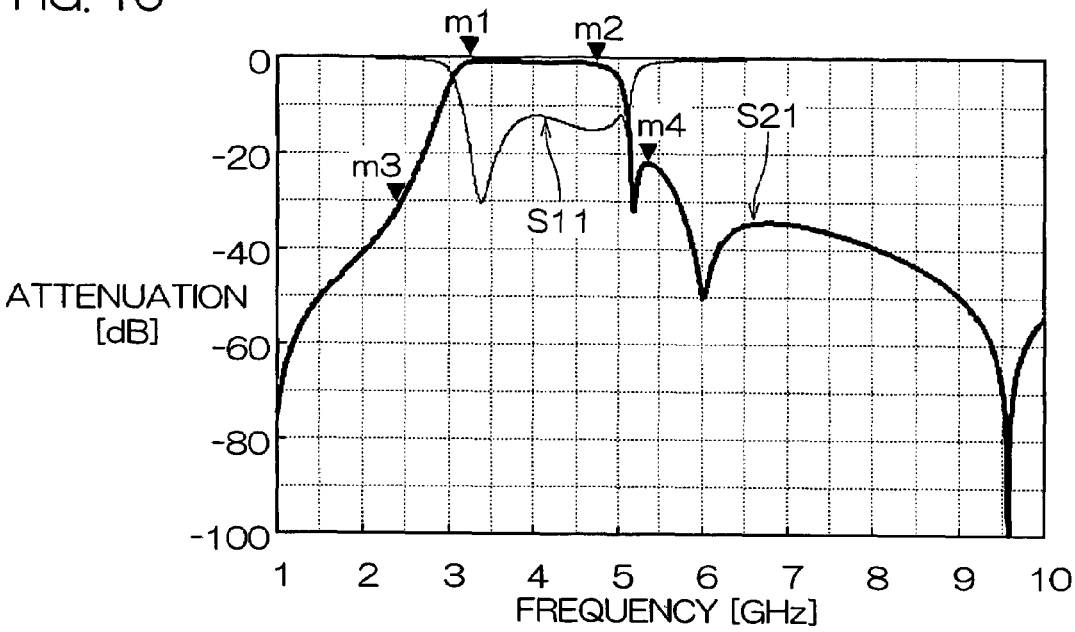
FIG. 10 is a graph showing a bandpass characteristic and a reflection characteristic of the bandpass filter shown in FIG. 2.

According to the results shown in FIG. 10, transmission loss within a bandwidth of about 1.5 GHz from 3.16 GHz (indicated by m1) to 4.75 GHz (indicated by m2) was less than 1.5 dB. An attenuation of more than 30 dB was obtained at 2.48 GHz (indicated by m3) where IEEE802.11b/g for W-LAN operates. In addition, an attenuation of about 32 dB was obtained at 5.15 GHz where IEEE802.11a for W-LAN operates.

Figure 11:
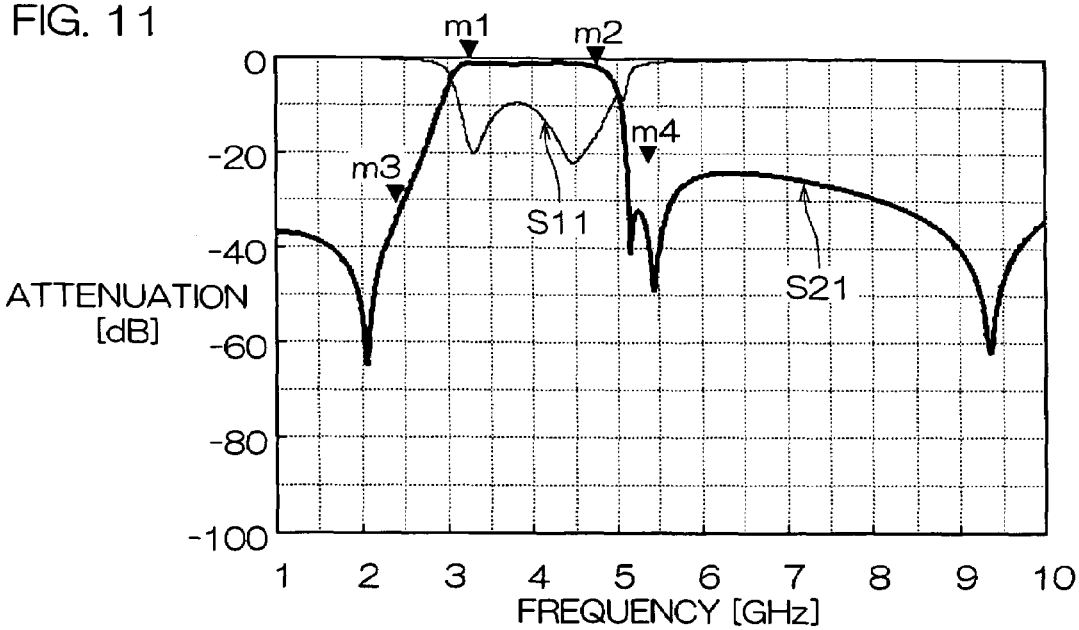
FIG. 11 is a graph showing a bandpass characteristic and a reflection characteristic of the bandpass filter shown in FIG. 6.

According to the results shown in FIG. 11, transmission loss within a range of from 3.16 GHz (indicated by m1) to 4.75 GHz (indicated by m2) was less than 1.5 dB, and an attenuation of more than 30 dB was obtained at 2.48 GHz (indicated by m3), which were the same as the results shown in FIG. 10. In addition, attenuation within a range of 5.15-5.35 GHz was more than 30 dB, which was improved by more than 8 dB as compared with that in FIG. 10.

Subsequently, a simulation using the circuit simulator ADS produced by Agilent Technologies was performed on a bandpass filter fabricated using the wiring patterns shown in FIGS. 4A-4H and FIGS. 5A-5E on condition that a ceramic substrate having a dielectric coefficient of 9.4 was used.

Figure 12:
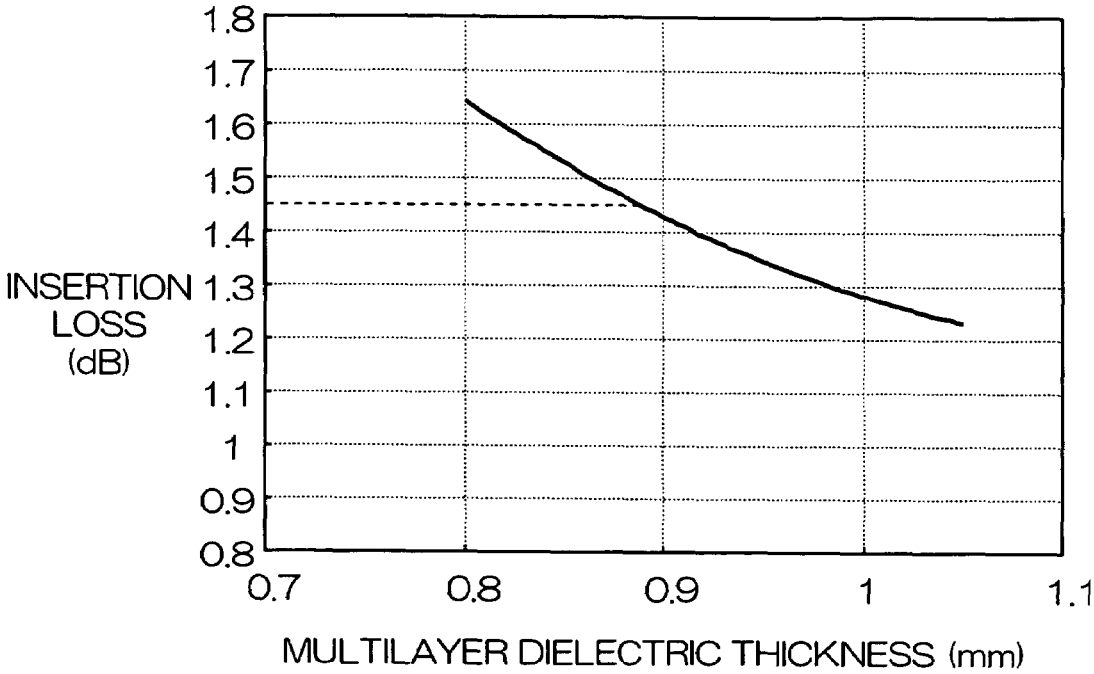
FIG. 12 is a graph showing the relationship between thickness of the multilayer dielectric and maximum loss within the passband of a bandpass filter.

FIG. 12 is a graph showing the relationship between thickness of the dielectric and maximum insertion loss within the passband.

According to FIG. 12, a dielectric having a dielectric coefficient of 9.4 and a thickness of 0.9 mm has a loss of 1.44 dB within the passband. The insertion loss is 1.5 dB or more at a dielectric thickness of 0.86 mm. When it is calculated for a dielectric thickness of 0.9 mm, the insertion loss is 1.5 dB at a dielectric coefficient of 9.83. Accordingly, it is apparent that the dielectric coefficient of the dielectric used for the bandpass filter of the present invention is not more than 10.

Meanwhile, when the dielectric thickness is 1.0 mm, the loss within the passband is 1.27 dB, leading to a good bandpass characteristic. This is the same as in the case where the dielectric coefficient is decreased to 8.46 when the dielectric thickness is 0.9 mm. As the dielectric thickness increases, the loss of the filter within the passband decreases. However, the heights of components are expected to be not more than 1.0 mm taking inclusion in cellular phones into consideration. For this reason, dielectric thicknesses greater than 1.0 mm are not preferable.

It is clear from the discussion above that the distance between the upper surface ground and the lower surface ground of the bandpass filter according to the present invention is not more than 1.00 mm.

Resonators with Q=163 were used for the verification above.

Figure 13:
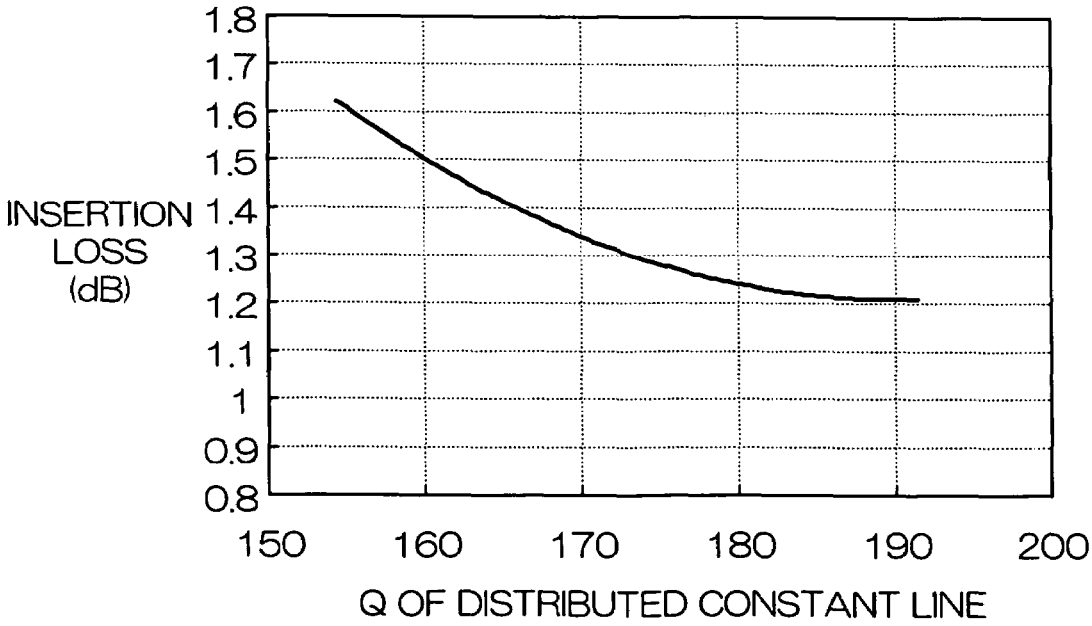
FIG. 13 is a graph showing the relationship between radio frequency conductivity (converted into Q) and loss within the passband of an electrode constituting a bandpass filter.

FIG. 13 is a graph showing the relationship between insertion loss of a bandpass filter according to the present invention and Q of distributed constant line. It is observed that as the value of Q of distributed constant line increases, loss of the bandpass filter decreases. The value of Q of distributed constant line is improved by increasing conductivity of the line at radio frequencies.

A bandpass filter according to the present invention was constructed using the circuit simulator ADS, and bandpass characteristic was measured, the results of which were: when the capacitances of the input capacitance C5 and output capacitance C6 were 0.8 pF, the maximum loss was −1.32 dB in a frequency range of from 3.16 GHz to 4.75 GHz. On the other hand, when the capacitances of the input capacitance C5 and output capacitance C6 were 0.4 pF, ripple was present within the passband, which narrowed the passband, resulting in a maximum loss of 1.68 dB. In addition, when the capacitances of the input capacitance C5 and output capacitance C6 were 1.5 pF, the steepness of attenuation was lost, resulting in increased attenuation at frequencies less than 3.1 GHz. This phenomenon was accompanied by a degraded bandpass characteristic, which was 1.66 dB at 3.16 GHz.

It is clear from the discussion above, the capacitances of the foregoing input capacitance C5 and output capacitance C6 of a bandpass filter according to the present invention are preferably at least 0.5 pF and less than 1.5 pF.

Incidentally, the MB-OFDM system, which is one system for UWB has been heretofore discussed as an example of the passband, the same discussion applies to a passband of 3.1 GHz to 4.9 GHz, which is a passband on the lower frequency side of another system, the DS-CDMA system. The bandpass filter according to the present invention can also be used for UWB of the DS-CDMA style by controlling the lengths, widths of the resonators 1-6, distances between them, and the capacitances of the capacitances C1-C4.

The invention claimed is:

1. A bandpass filter comprising an input terminal electrode, an output terminal electrode, and a plurality of resonators formed in a multilayer dielectric substrate comprising dielectric layers stacked one upon another, wherein the plurality of resonators each comprises a conductor pattern whose length in a signal propagation direction is basically $\lambda/4$ when the propagation wavelength at a generally center frequency of a passband is represented by $\lambda$, one ends of the plurality of resonators are each grounded as grounded ends, the grounded ends being arranged on the same side of the multiplayer dielectric substrate and juxtaposed in sequence, and the plurality of resonators comprise six resonators from a first resonator to a sixth resonator, the resonators being arranged such that an ungrounded end of the first resonator is connected to the input terminal electrode through capacitance or inductance, an ungrounded end of the sixth resonator is connected to the output terminal electrode through capacitance or inductance, adjacent resonators of the second to fifth resonators are electromagnetically coupled with each other, and ungrounded ends of the first resonator and the second resonator, ungrounded ends of the first resonator and the third resonator, ungrounded ends of the sixth resonator and the fourth resonator, ungrounded ends of the sixth resonator and the fifth resonator are coupled with each other by being connected together through capacitances.

2. The bandpass filter according to claim 1, wherein distances between ungrounded ends of all of the first to sixth resonators and capacitances connected to the ungrounded ends are generally equal.

3. The bandpass filter according to claim 1, wherein grounded ends of the first resonator and the sixth resonator are disposed at locations shifted by predetermined distances from the locations of grounded ends of the second to fifth resonators to the side of the ungrounded ends thereof, and a part of the first resonator in proximity to the ungrounded end thereof bends toward the second resonator, and a part of the sixth resonator in proximity to the ungrounded end thereof bends toward the fifth resonator.

4. The bandpass filter according to claim 1, wherein a part of the second resonator in proximity to the ungrounded end thereof bends toward the first resonator, and a part of the fifth resonator in proximity to the ungrounded end thereof bends toward the sixth resonator.

5. The bandpass filter according to claim 1, wherein a part of the third resonator in proximity to the ungrounded end thereof bends toward the first resonator, and a part of the fourth resonator in proximity to the ungrounded end thereof bends toward the sixth resonator.

6. The bandpass filter according to claim 1, wherein the capacitances comprise capacitances created in the stacking direction by conductor patterns provided on different dielectric layers being opposed to each other, and a first capacitance is formed between a conductor pattern connected to the ungrounded end of the first resonator and a conductor pattern connected to the ungrounded end of the second resonator, a second capacitance is formed between a conductor pattern connected to the ungrounded end of the first resonator and a conductor pattern connected to the ungrounded end of the third resonator, a third capacitance is formed between a conductor pattern connected to the ungrounded end of the sixth resonator and a conductor pattern connected to the ungrounded end of the fourth resonator, and a fourth capacitance is formed between a conductor pattern connected to the ungrounded end of the sixth resonator and a conductor pattern connected to the ungrounded end of the fifth resonator.

7. The bandpass filter according to claim 6, wherein the first capacitance is formed by disposing the conductor pattern connected to the ungrounded end of the second resonator on and under the conductor pattern connected to the ungrounded end of the first resonator, the second capacitance is formed by disposing the conductor pattern connected to the ungrounded end of the third resonator on and under the conductor pattern connected to the ungrounded end of the first resonator, the third capacitance is formed by disposing the conductor pattern connected to the ungrounded end of the fourth resonator on and under the conductor pattern connected to the ungrounded end of the sixth resonator, and the fourth capacitance is formed by disposing the conductor pattern connected to the ungrounded end of the fifth resonator on and under the conductor pattern connected to the ungrounded end of the sixth resonator.

8. The bandpass filter according to claim 6, wherein an upper ground electrode and a lower ground electrode are provided so as to vertically sandwich the six resonators in the stacking direction, and the first to fourth capacitances are formed in a region sandwiched by the upper ground electrode and the lower ground electrode.

9. The bandpass filter according to claim 1, wherein the input terminal electrode and the output terminal electrode are electrically coupled with each other by being connected together through a capacitance.

10. The bandpass filter according to claim 9, wherein the capacitance is formed in the stacking direction by conductor patterns provided on different dielectric layers being opposed to each other, and an independent conductor pattern is formed on a layer that is different from a layer on which a conductor pattern connected to the input terminal electrode is provided and a layer on which a conductor pattern connected to the output terminal electrode is provided.

11. Wireless communication equipment comprising an antenna, a bandpass filter according to claim 1 for passing transmission signal transmitted at the antenna, and receiving signal received at the antenna, an RFIC for processing the transmission signal and the receiving signal, and a baseband IC for processing baseband signals.

12. The bandpass filter according to claim 1, wherein the input terminal electrode and the output terminal electrode are formed on a front surface of the multilayer dielectric substrate.

13. The bandpass filter according to claim 1, wherein the plurality of resonators are formed inside the multiplayer dielectric substrate.

* * * * *